US007493721B2

(12) United States Patent
Swan

(10) Patent No.: US 7,493,721 B2
(45) Date of Patent: Feb. 24, 2009

(54) MOUNTING ASSEMBLY WITH POSITIVE STOP FOR ACTUATOR ARM

(76) Inventor: Richard E. Swan, 171 West St., E. Bridgewater, MA (US) 02333

( * ) Notice: Subject to any disclaimer, the term of this patent is extended or adjusted under 35 U.S.C. 154(b) by 0 days.

(21) Appl. No.: 11/844,602

(22) Filed: Aug. 24, 2007

(65) Prior Publication Data

US 2008/0134559 A1 Jun. 12, 2008

Related U.S. Application Data

(60) Provisional application No. 60/869,337, filed on Dec. 11, 2006.

(51) Int. Cl.
*F41G 1/38* (2006.01)

(52) U.S. Cl. ..... 42/125; 42/90; 42/127

(58) Field of Classification Search ..... 42/90, 42/111, 114, 117, 124, 125, 127, 146
See application file for complete search history.

(56) References Cited

U.S. PATENT DOCUMENTS

| | | | | |
|---|---|---|---|---|
| 1,428,655 | A | 9/1922 | Noske | |
| 2,161,051 | A | 6/1939 | Humeston | |
| 3,877,166 | A | 4/1975 | Ward | |
| 4,845,871 | A | 7/1989 | Swan | |
| 4,860,480 | A | 8/1989 | Ruger | |
| 4,905,396 | A | 3/1990 | Bechtel | |
| 5,142,806 | A * | 9/1992 | Swan | 42/114 |
| 5,155,915 | A | 10/1992 | Repa | |
| 5,276,988 | A | 1/1994 | Swan | |
| 5,606,818 | A | 3/1997 | Hardee | |
| 5,669,173 | A | 9/1997 | Rodney, Jr. | |
| 5,680,725 | A | 10/1997 | Bell | |
| 5,787,630 | A * | 8/1998 | Martel | 42/125 |
| 5,941,489 | A * | 8/1999 | Fanelli et al. | 248/298.1 |
| 6,442,883 | B1 | 9/2002 | Waterman et al. | |
| 6,449,893 | B2 | 9/2002 | Spinner | |
| 6,490,822 | B1 | 12/2002 | Swan | |
| 6,513,276 | B2 | 2/2003 | Mendoza-Orozco | |
| 6,598,333 | B1 | 7/2003 | Randazzo et al. | |

(Continued)

OTHER PUBLICATIONS

Technical Manual, TM 9-4931-710-14&P, Operator, Organization, Direct Support and General Support Maintenance Manual, Headquarters, Department of the Army, Aug. 1986.

*Primary Examiner*—Bret Hayes
*Assistant Examiner*—Michael D David
(74) *Attorney, Agent, or Firm*—Barlow, Josephs & Holmes, Ltd.

(57) ABSTRACT

An improved mounting assembly is provided that is configured to be releasably mounted onto a standard dovetail rail profile and includes a positive index that corresponds to a fully opened position. The mounting assembly includes a boss formation that extends from one side thereof. A camming member and an actuator arm are installed into the boss formation and serve as a means for engaging and disengaging the mounting assembly relative to the dovetail rail. A shoulder formation is provided on the boss formation adjacent the actuator arm and extends upwardly such that the shoulder prevents over rotation of the actuator arm allowing the actuator arm to be positioned in a fully disengaged, open position where it will not interfere with removal or installation of the mounting assembly relative to the rail.

1 Claim, 7 Drawing Sheets

U.S. PATENT DOCUMENTS

| | | | | |
|---|---|---|---|---|
| 6,606,813 | B1 * | 8/2003 | Squire et al. | 42/90 |
| 6,922,934 | B1 | 8/2005 | Huan | |
| 6,931,778 | B1 | 8/2005 | Nelson et al. | |
| 7,272,904 | B2 | 9/2007 | Larue | |
| 7,370,449 | B1 * | 5/2008 | Beckmann | 42/90 |
| 2004/0148842 | A1 | 8/2004 | Aalto et al. | |
| 2005/0241212 | A1 * | 11/2005 | Swan | 42/127 |
| 2006/0117636 | A1 * | 6/2006 | Newhall et al. | 42/124 |
| 2006/0123686 | A1 | 6/2006 | Larue | |
| 2006/0207156 | A1 | 9/2006 | Larue | |

* cited by examiner

MOUNTING ASSEMBLY WITH POSITIVE STOP FOR ACTUATOR ARM

CROSS-REFERENCE TO RELATED APPLICATIONS

This application is related to and claims priority from earlier filed U.S. Provisional Patent Application No. 60/869,337, filed Dec. 11, 2006.

BACKGROUND OF THE INVENTION

The present invention relates generally to accessory mounting assemblies for combat weapons such as the modular integrated accessory systems found on most modern combat weapons. More specifically, the present invention relates to a mounting assembly including a shoulder formation that prevents over rotation of the actuator arm when moved to the open position.

As the field of combat and commercial weaponry expands, numerous add-on enhancements have become available for attachment to standard firearms, thereby significantly upgrading the capability of the firearm. Of particular interest in the area of combat weapons is the well-known M16/M4 weapon system (M16 and M4 are trademarks of Colt Defense, Inc.). The M16 has been in service for a number of years and will continue to be a popular rifle both in U.S. and foreign militaries for the foreseeable future. Generally, the M16/M4 weapon 2, as depicted in FIG. 1, includes a lower receiver 4, upper receiver 6, butt stock 8, and barrel 10.

The newer models of the M16/M4 weapons further include a mil-std 1913 dovetail rail 12 extending along the top of the upper receiver. This integrated receiver rail 12 provides a convenient mounting point for many types of enhancement devices such as scopes and other sighting devices. However, space on the upper receiver rail 12 is limited, and many military personnel often have multiple sighting devices that are each tailored to perform in different combat situations. In addition, there are a variety of lighting devices, handgrips, etc. that could also be attached to the weapon for enhanced use of the weapon. The difficulty is that there is simply not enough space on the integrated rail provided on the upper receiver to accommodate all of the desired accessories. Accordingly, the increasing development and refinement of laser sights, infrared lighting, visible lighting, night vision, and specialized scopes and magnifiers, and other accessories continues to drive the need for versatile and reliable integration systems that include additional mil-std 1913 dovetail rails positioned above or around the barrel of the weapon that can support this important equipment and yet stand the test of rugged military use and abuse.

Responding to this need, the applicant has developed a modular integrated rail system (A.R.M.S.® S.I.R.® system), which has been well received by the military and has become popular with several branches of the military (See FIG. 2). The A.R.M.S. S.I.R. system is fully described in U.S. Pat. No. 6,490,822, the entire contents of which are incorporated herein by reference. These modular integrated rail systems for combat weapons 2 generally include an upper hand guard 14, a means 16 for securing the upper hand guard 14 to the weapon 2, a lower firearm accessory 18 (in most cases this is a lower hand guard), various optional rail segments, and in many cases, a sling swivel 20 for attaching a shoulder sling to carry the weapon 2.

The upper hand guard 14 is the main structural element of the system. The upper hand guard is 14 generally semi-cylindrical in shape and has a forward end and a rearward end and a mil-std 1913 dovetail rail 22 extending longitudinally between the forward end and the rearward end. The semi-cylindrical upper hand guard 14 further includes symmetrically opposing side walls that extend outwardly and downwardly from the dovetail rail and terminate in symmetrically opposing longitudinally extending mounting channels. The mounting channels are used to mount various accessories, such as a lower hand guard 18 or a grenade launcher, to the upper hand guard 14.

An interface means 16 is provided at the rearward end of the upper hand guard 14 to removably secure the upper hand guard 14 to the firearm 2. In the original S.I.R. system as shown in U.S. Pat. No. 6,490,822, the clamp is an elongated clamping rail that secures the upper hand guard 14 to the dovetail rail 12 on the top of the upper receiver 6 of the weapon 2. In the newer S.I.R. systems, the interface means is a U-shaped yoke or clamp that secures the upper hand guard 14 to the barrel nut.

As is well known in this area, field modification of weapons is critical in combat situations. For example, it may be desired to swap the lower hand guard for a grenade launcher, which can be attached to the upper hand guard, or to add an optional rail segment for securing an added accessory. Similarly, there may be a desire to exchange various different sights or lighting accessories that are mounted on the various dovetail rails positioned around the weapon. In this regard standardized attachment assemblies have been developed to allow quick and easy removal and mounting of these devices relative to the dovetail rails. Such an attachment device was disclosed in U.S. Pat. No. 5,276,988, issued on Jan. 11, 1994 to the present applicant, the contents of the patent being incorporated herein by reference. Generally, the prior art attachment assemblies included a main body having a lower portion that is configured to engage the dovetail rail found on most modern combat weapons and an upper portion that can take on a variety of configurations depending on the accessory that is to be mounted thereon. The lower portion of the mounting assembly has a first engagement member extending downwardly along one side thereof for engaging one side of the dovetail rail. Further, a boss formation is provided adjacent the side of the main body to receive a clamping assembly that is particularly suited to be releasably engageble with a second side of the dovetail rail such that the clamping assembly cooperates with the first engagement member to retain the modular mounting assembly in its installed position on the dovetail rail.

The difficulty with the prior art attachment assemblies is that the actuator arm that serves to open and close the clamping portion of the attachment assembly is typically allowed to freely rotate over a full 180-degree arc. In this configuration, while a positive closed/locked position is provided a positive open position is not provided. As the clamping foot of the mounting assembly is released, it can tend to be over rotated to a point where it begins to reengage the firearm rail system. As a result, such over rotation can interfere with easy installation and removal of the mounting assembly. Further, in the typical military environment, as the devices become dirty, there exists a need to have positive and repeatable positioning of the various components since fussy devices having small tolerances often interfere with the device operation in such rugged operating environments.

Accordingly, there is a perceived need for an improved modular mounting assembly that allows for the releasable mounting of various accessories onto the standard dovetail rail found on modern combat weapons. Further, there is a perceived need for a modular mounting assembly that can be reliably mounted onto a dovetail rail while including an actuator that includes an indexing means to indicate that the actuator is in the correct locked or open position.

BRIEF SUMMARY OF THE INVENTION

In this regard, the present invention provides for an improved mounting assembly that is configured to be releasably attached to a standard dovetail rail profile and includes a positive index that corresponds to a fully opened position. The mounting assembly of the present invention is particularly suited for use in connection with any firearm that utilizes a standard dovetail rail system. The mounting assembly is configured in the same manner as a traditional prior art mounting interface devices and includes a lower clamping portion that engages the dovetail rail found on most modern combat weapons and an upper accessory interface portion that can take a variety of configurations depending on the accessory that is to be mounted thereon.

In the scope of the present invention, the mounting assembly includes a boss formation that extends from one side thereof. A clamping assembly that includes a camming member having a foot and a shaft extending upwardly therefrom is installed into the boss formation such that the foot of the camming member is received in a position adjacent the bottom of the mounting assembly body and the shaft extends upwardly through the boss formation. An actuator arm is installed onto the top end of the shaft adjacent the top of the boss formation in a manner that engages the shaft and provides a means for the user to rotate the shaft and the foot such that the foot can be engaged and disengaged with the dovetail rail to hold the mounting assembly on the dovetail rail.

The mounting assembly of the present invention further includes a shoulder formation positioned on the boss formation adjacent the position on the mount where the actuator arm is received. The shoulder extends upwardly from the body of the mounting assembly and is positioned in such a manner that the shoulder prevents over rotation of the actuator arm beyond the fully disengaged position. As was the case in the prior art, the actuator arm is often over rotated when the user opens the mounting lever assembly. The result of such over rotation often causes the camming foot to interfere with easy installation and/or removal of the mounting assembly relative to the dovetail rail. The shoulder formation of the present invention overcomes this difficulty by providing a positive stop for the actuator arm once it reaches the fully open position. In the fully open position, with the actuator arm against the shoulder formation, the camming foot is positioned in a fully disengaged position where it will not interfere with removal or installation of the mounting assembly relative to the rail.

Accordingly, it is an object of the present invention to provide an improved mounting assembly that allows for the releasable mounting of various accessories onto the standard dovetail rail found on modern combat weapons. Further, it is an object of the present invention to provide a mounting assembly that can be reliably mounted onto a dovetail rail while including an actuator that employs an indexing means to indicate that the actuator is in the correct locked or open position. It is still a further object of the present invention to provide a mounting assembly that includes an indexing means to indicate that the actuator is in the fully open position thereby ensuring that the actuator does not interfere with installing or removing the mounting assembly relative to the dovetail rail.

These, together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
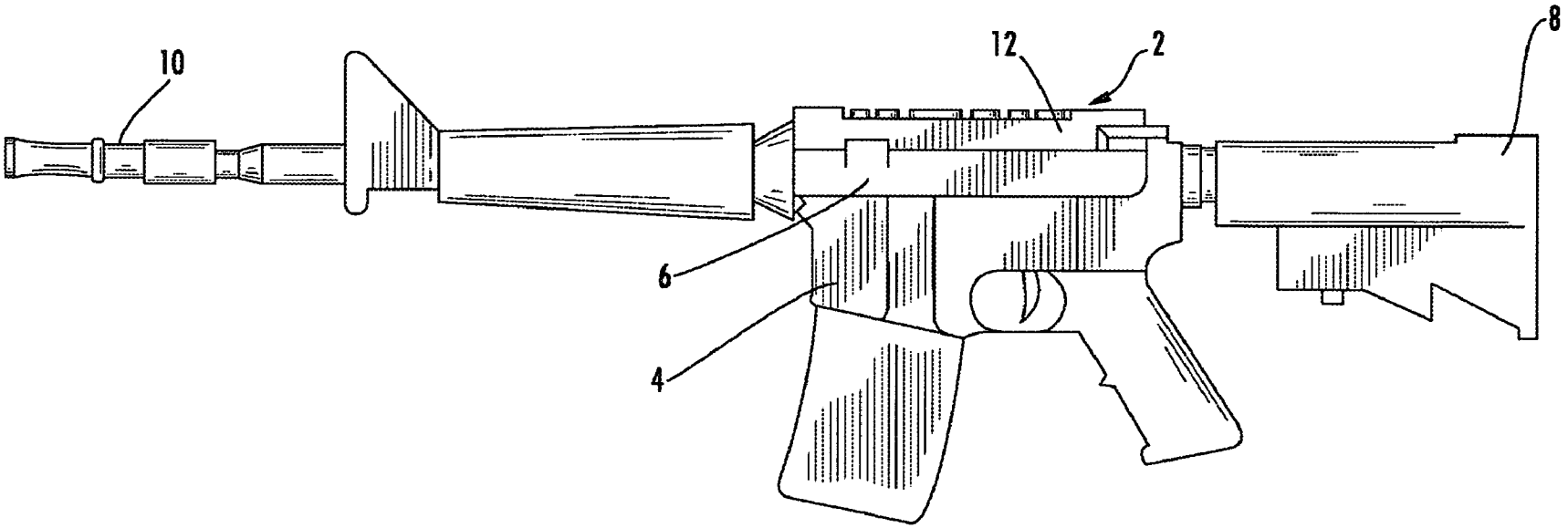
FIG. 1 (PRIOR ART)
FIG. 1 is a side view of a prior art combat firearm.
Figure 2:
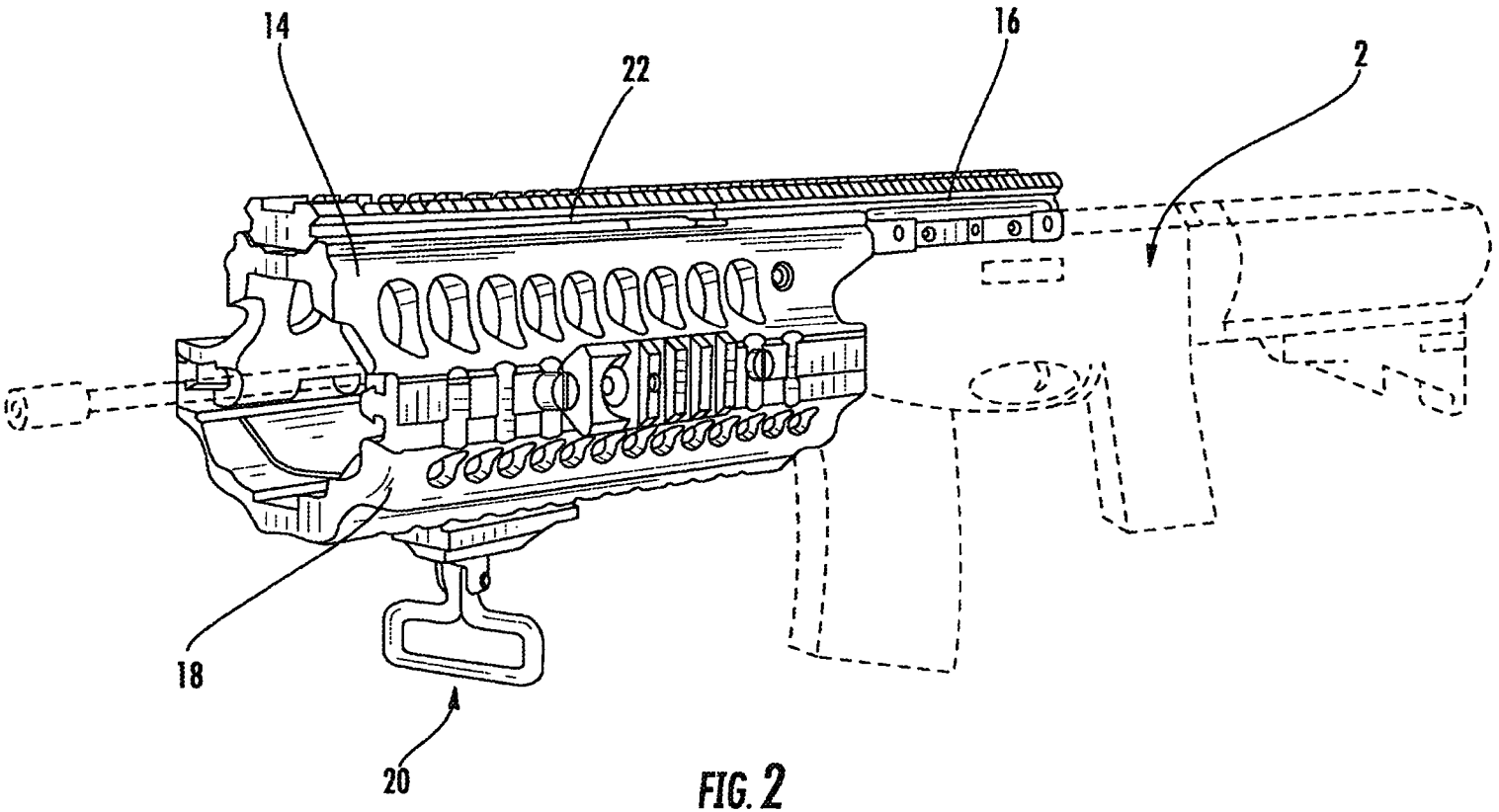
FIG. 2 (PRIOR ART)
FIG. 2 is a perspective view of a prior art rail interface system.
Figure 3:
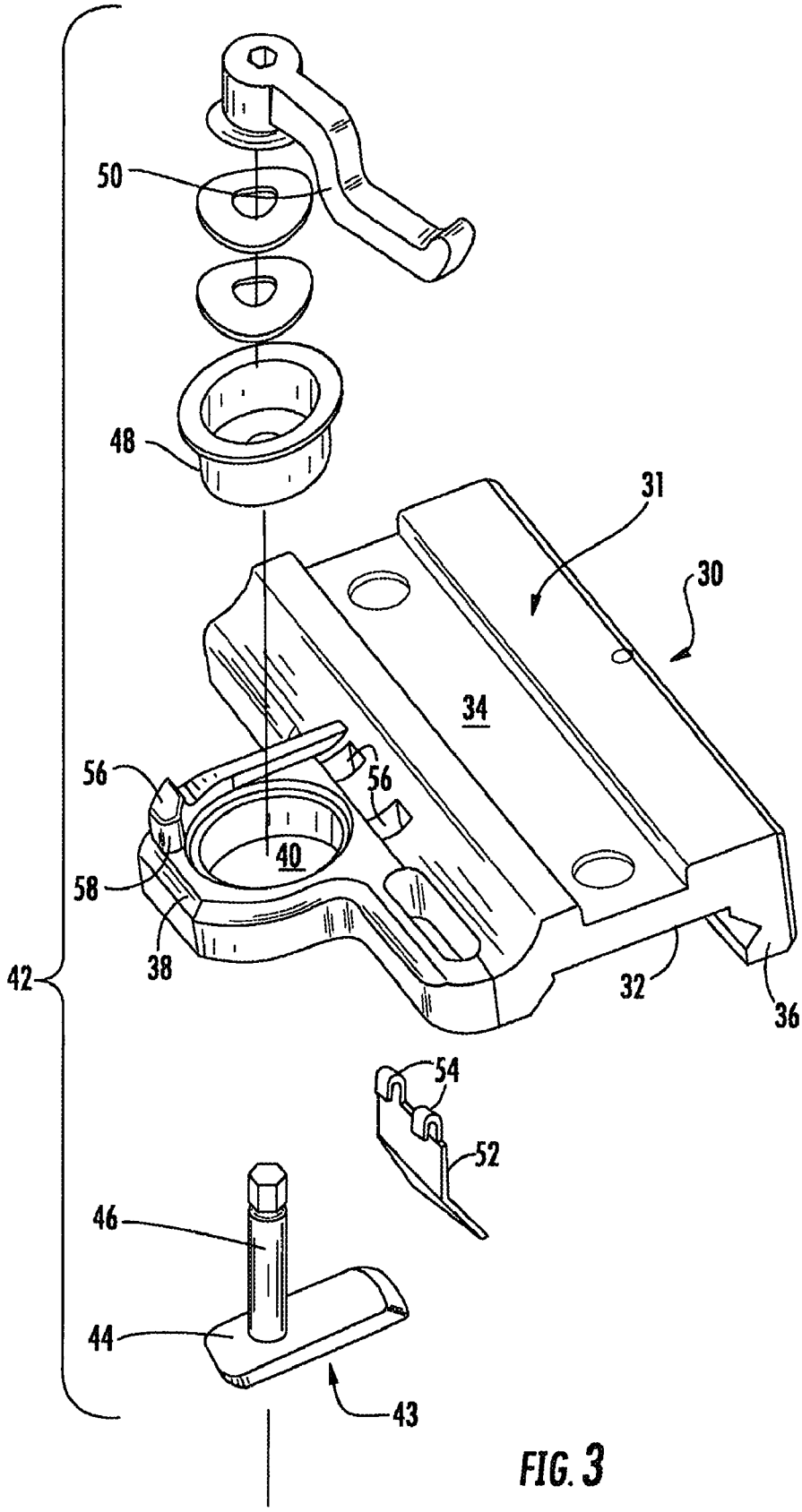
FIG. 3 is an exploded perspective view of the mounting assembly of the present invention.
Figure 4:
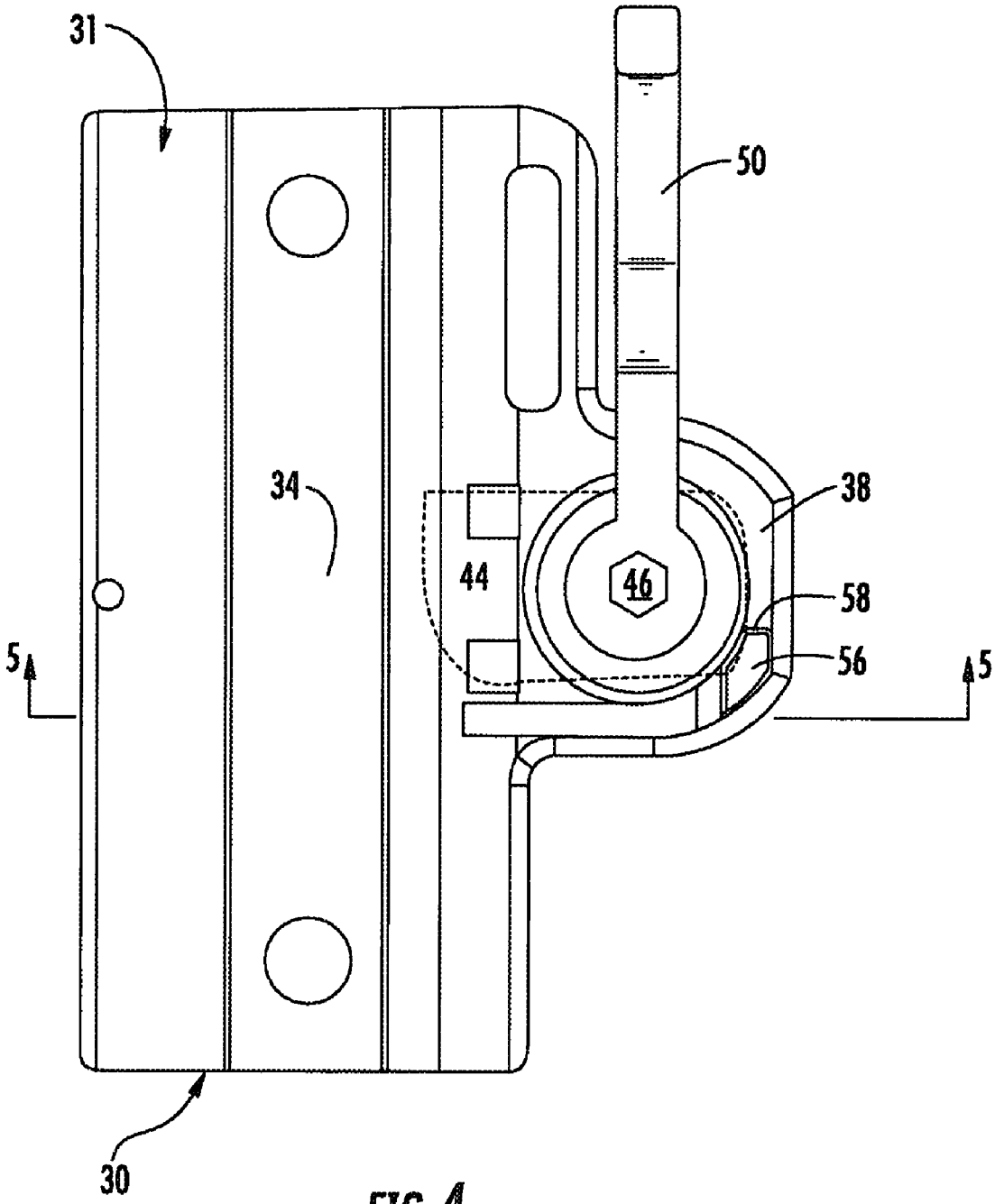
FIG. 4 is a top view of the mounting assembly of the present invention in a fully engaged position.
Figure 5:
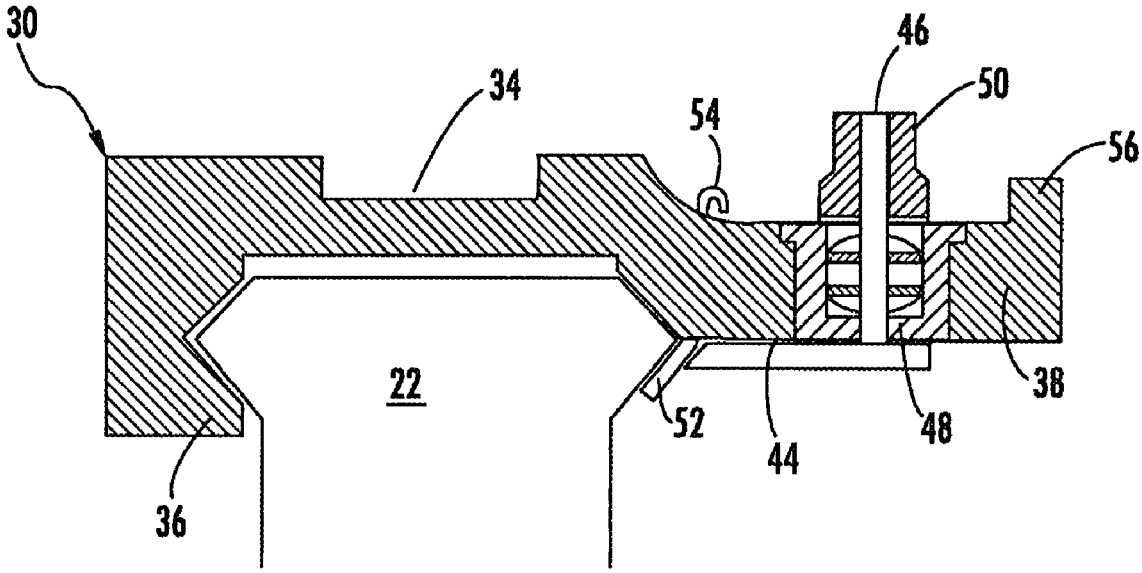
FIG. 5 is a cross sectional view taken along line 5-5 of FIG. 4.

Now referring to the drawings, the mounting assembly is shown and generally illustrated at 30 in FIGS. 3-5. The mounting assembly 30 is configured to be releasably attached to a standard dovetail rail profile 22 as is depicted in FIGS. 1 and 2, and includes a positive index that corresponds to both the fully opened and fully closed positions. The mounting assembly 30 of the present invention is particularly suited for use in connection with any firearm that utilizes a standard dovetail rail system. Further, the mounting assembly 30 is configured in substantially the same manner as a traditional prior art mounting interface devices. The mounting assembly 30 includes a lower clamping portion that engages the dovetail rail 22 found on most modern combat weapons and an upper accessory interface portion that can take on a variety of configurations depending on the accessory that is to be mounted thereon.

Turning now to FIG. 3, as can be seen, the mounting assembly 30 includes a main body 31 that is configured in substantially the same manner as a traditional prior art device and further includes a lower portion 32 that is configured to engage the dovetail rail found on most modern combat weapons and an upper portion 34 that can take on a variety of configurations depending on the accessory that is to be mounted thereon. The lower portion 32 of the mounting assembly has a first engagement member 36 extending downwardly along one side thereof for engaging one side of the dovetail rail. Further, a boss formation 38 is provided adjacent the side of the main body 31 wherein the boss formation 38 includes an opening 40 therein to receive a clamping assembly 42.

The clamping assembly 42 is particularly suited to be releasably engageble with a second side of the dovetail rail such that the clamping assembly 42 cooperates with the first engagement member 36 to retain the modular mounting assembly 30 in its installed position on the dovetail rail. It is preferred that the clamping assembly be rotatably movable between an engaged position wherein the clamping assembly 42 engages the second side of said dovetail rail and cooperates with the first engagement member 36 on the lower portion 32 of the modular mounting assembly 30 to retain the mounting assembly 30 on the dovetail rail, and a disengaged position wherein the clamping assembly 42 is disengaged, thereby allowing the mounting assembly 30 to be removed from the dovetail rail.

In a preferred embodiment the clamping assembly 42 includes a camming member 43 having a foot 44 and a shaft 46 extending upwardly therefrom such that the shaft 46 is installed into the opening 40 in the boss formation 38 on the mounting assembly 30. Further, to enhance the overall fit and rotation of the clamping assembly 42, a bushing 48 may also be provided in the opening 40 between the boss formation 38 and the shaft 46. Once the shaft 46 is inserted into the opening 40 in the boss formation 38, the foot 44 is received in a position adjacent the bottom surface of both the boss formation 38 and the mounting assembly 38 itself. An actuator arm 50 is installed onto the top end of the shaft 46 and is received adjacent the top of the mounting assembly 30. The actuator arm 50 engages the shaft 46 and provides a means for the user to rotate the shaft 46 and the foot 44 allowing the foot 44 to be engaged and disengaged with the second side of the dovetail rail. In this manner, the clamping assembly 42 and the first engagement member 36 cooperate to hold the mounting assembly on the dovetail rail.

There is also shown generally a buffer element 52 having a flat horizontal base portion with an arm 54 at each end of the base extending upwardly at an oblique angle of 135 degrees. The free end of each arm is curved approximately 150 degrees. Two side-by-side openings 56, corresponding in separation to the separation between buffer element 52 arms 54, are formed in the mounting assembly 30. The arms 54 on the top of the buffer element 52 are slid through the openings 56 thereby retaining the buffer element 52 in the mounting assembly 30. In this arrangement, the buffer element 52 is positioned between the surface of the dovetail rail and the foot 44 of the clamping assembly 42. Rotation of the actuator arm 50, the shaft 46 and in turn the foot 44 serves to press the buffer element 52 into the side of the dovetail rail. By placing the buffer element 52 in this position, the buffer element 52 prevents the foot 44 from directly touching and thereby scratching the dovetail rail. The buffer element 52 further distributes the clamping pressure over a greater area and prevents distortion of the aluminum dovetail rail 22.

Figure 6:
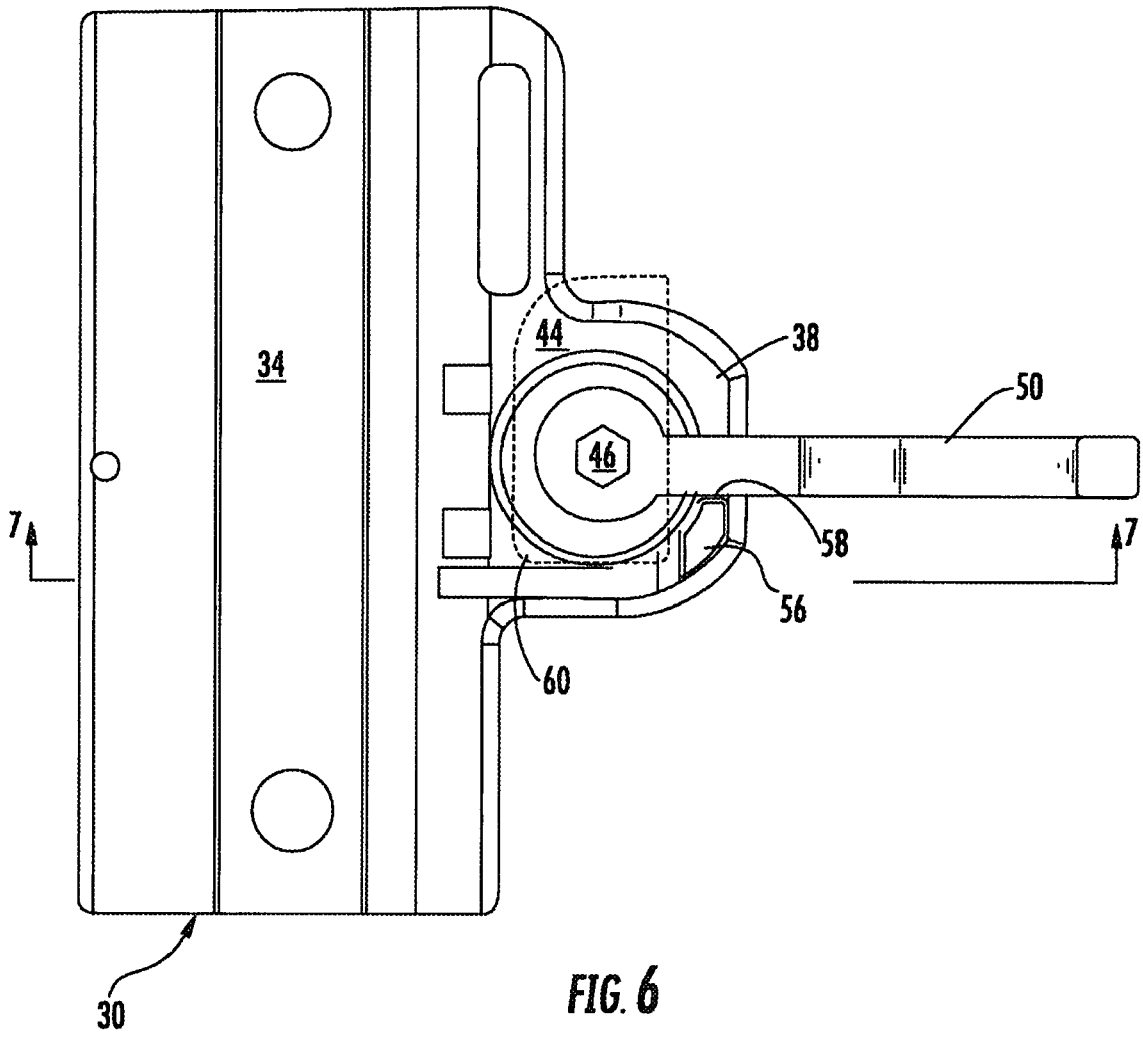
FIG. 6 is a top view of the mounting assembly of the present invention in a fully disengaged position.
Figure 7:
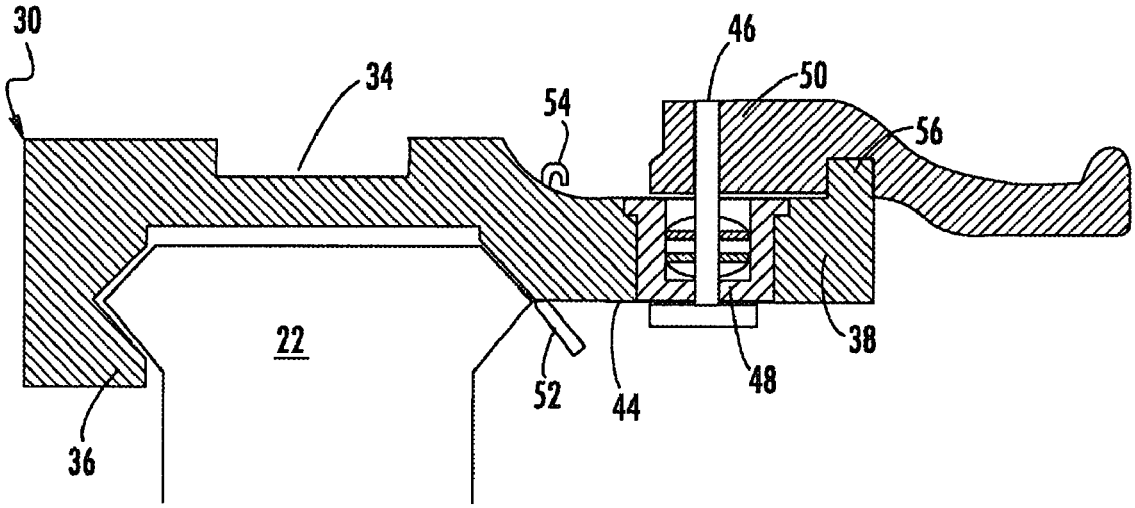
FIG. 7 is a cross sectional view taken along line 7-7 of FIG. 6.

In the scope of the present invention, a shoulder formation 56 is provided on the boss formation 38. The shoulder 56 extends upwardly from the boss formation 38 and is positioned in such a manner that the shoulder 56 prevents over rotation of the actuator arm 50. Turning now to FIGS. 4-7, as was stated above, the actuator arm 50 is often over rotated when the user opens the mounting assembly 30. The result of such over rotation often causes the foot 44 to interfere with easy installation and/or removal of the mounting assembly 30 from the rail. The present invention overcomes this difficulty by providing a shoulder 56 on the boss formation 38 of the mounting assembly 30. The shoulder 56 acts as a positive stop for the actuator arm 50 once it reaches the fully open/disengaged position. In FIGS. 4 and 5, the mounting assembly 30 can be seen in a closed engaged position. The actuator arm 50 is rotated against the main body 31 of the mounting assembly 30 and the foot 44 can be seen in dotted lines as being rotated to a position where it engages the side of the dovetail rail 22 to firmly retain the mounting assembly 30 in an installed position. Turning now to FIGS. 6 and 7, the mounting assembly 30 can be seen in an open disengaged position. The actuator arm 50 is rotated outwardly to a position that is substantially perpendicular to the main body 31 of the mounting assembly 30 and can be seen to rest against the sidewall 58 of the shoulder 56. The foot 44 can be seen to be positioned in a fully disengaged position where it will not interfere with removal of installation of the mounting assembly 30 relative to the rail 22. It can further be seen that if the shoulder 56 were not provided as in the prior art, additional rotation of the actuator arm 50 would allow the back corner 60 of the foot 44 to begin to encroach against the rail 22 and thereby interfere with removal/installation.

The shoulder 56 in the present invention is depicted as being a monolithically formed component that is milled integrally with the boss 38. It should be appreciated by one skilled in the art that the shoulder 56 may also be formed by installing a separately machined object such as a pin, a wedge, a block or the like onto the boss 38 to prevent further rotation of the actuator 50 past a fully disengaged position. For example the shoulder 56 may be a pin or a block that is attached to the boss 38.

In addition to the benefits described above, another benefit of using a shoulder 56 to limit the travel when opening the actuator 50 is that it allows tandem mounting of various devices wherein a fully opening lever would interfere with or bump into an adjacent assembly installed in limited rail space. Further, the inclusion of the shoulder 56 for the actuator arm 50 makes the mounting assembly 30 a much faster and more positive quick disconnect system.

Accordingly, it can be seen that the present invention provides a unique and novel modular accessory mount that fills a critical need for soldiers in the field by ensuring positive and reliable operation. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A modular mounting assembly for attaching an accessory to a dovetail rail on a firearm, said modular mounting assembly comprising:

a body having a lower portion and an upper portion, said lower portion configured to engage a first side of a dovetail rail, said upper portion configured to receive and retain said accessory;

a boss formation extending outwardly from a side of said body and including an opening therein;

a clamping assembly received within said opening in said boss formation, said clamping assembly including a camming foot configured and arranged adjacent a bottom surface of said boss formation, a shaft extending upwardly from said camming foot and extending through said opening in said boss formation, and an actuator arm coupled to said camming foot, said camming foot being rotatably movable by movement of said actuator arm between an engaged position wherein said camming foot engages a second side of said dovetail rail and cooperates with said lower portion to retain said mounting assembly on said dovetail rail and a disengaged position wherein said camming foot is disengaged from said second side of said dovetail rail thereby allowing said mounting assembly to be removed from said dovetail rail; and a shoulder formation extending upwardly from said boss formation, said shoulder formation being configured and arranged to prevent rotation of said actuator arm beyond said disengaged position where said camming foot is disengaged from said second side of said dovetail rail, said shoulder formation preventing said actuator arm from rotating more than approximately 90 degrees.

* * * * *